United States Patent [19]

Salomon

[11] 4,097,062

[45] Jun. 27, 1978

[54] SKI BINDING

[75] Inventor: Georges Pierre Joseph Salomon, Annecy, France

[73] Assignee: Etablissements Francois et Fils, Annecy, France

[21] Appl. No.: 710,805

[22] Filed: Aug. 2, 1976

[30] Foreign Application Priority Data

Aug. 28, 1975 France ..... 75 26507

[51] Int. Cl.[2] ..... A63C 9/08

[52] U.S. Cl. ..... 280/618; 280/631

[58] Field of Search ..... 280/617, 618, 631, 632

[56] References Cited

U.S. PATENT DOCUMENTS 3,317,217 5/1967 Poiger ..... 280/632

3,554,571 1/1971 Smolka ..... 280/632

3,836,163 9/1974 Hashioka ..... 280/632

*Primary Examiner*—Robert R. Song

*Attorney, Agent, or Firm*—Pollock, Vande Sande & Priddy

[57] ABSTRACT

Hinged to a mounting are, on the one hand, a lever pivoting about a first axis and, on the other hand, a boot-removing lever pivoting about a second axis. The lever carries a roller cooperating with a ramp on the jaw, for the purpose of keeping the jaw in the closed position. A resilient element, applying traction, is located between two points of attachment on the lever and the jaw. The present binding may be used as a heel-piece.

15 Claims, 6 Drawing Figures

SKI BINDING

The present invention relates to a binding designed to hold a boot, more particularly the heel thereof, to a support such as a ski, or to a plate fitted to a ski.

The invention relates, more particularly, to a binding comprising a jaw arranged to pivot, upon a mounting, about a first axis secured thereto, and a lever for removing the boot arranged to pivot about a second axis secured to the mounting, the lever and jaw cooperating by means of a ramp-and-stop system and being urged into contact with each other by means of a resilient element which makes it possible to keep the jaw in the position in which it holds the boot to the ski.

Devices of this kind are already known, for instance from published German Patent Applications Nos. 1,728,514 and 2,125,357 and from German Utility Models Nos. 7,023,403 and 7,127,472. The devices described in these references are heel-pieces which permit:

voluntary unlocking of the binding by actuation of the boot-releasing lever which compresses a spring acting between the jaw and the lever, the pivoting movement of the lever releasing the jaw and making it possible for the skier to raise the boot without any effort;

automatic refitting of the binding, or "step-in", after the jaw has been opened, this refitting being made possible by the presence of a pedal associated with the jaw.

These known bindings, however, have certain disadvantages. For instance: on the one hand, they are quite bulky, due to the need for locating the axes of pivot at a distance from the jaw and the lever, which runs the risk of causing the spring to buckle, as may be seen particularly well in German Patent Application No. 2,125,357; on the other hand, their design restricts the displacement of the pivoting parts and thus restricts the resilient travel of the jaw. This restriction of the angular displacement of the pivoting parts is one of the disadvantages which the above application No. 1,728,514 seeks to overcome by increasing the complexity of the binding. It is essential that a binding be able to function satisfactorily, even if the ski boots have soles of different thicknesses, or if there is snow between the boot and the support, which amounts to the same thing as a difference in sole thickness.

If the resilient travel of the jaw is unable to allow for such conditions, the binding will not operate properly and there may be a danger of the skier falling.

It is the purpose of the present invention to provide a device of the type mentioned hereinbefore, which will overcome the disadvantages of known bindings.

The binding according to the invention takes up little room on the ski, allows the resilient element to operate under satisfactory mechanical conditions, and allows sufficient resilient travel of the jaw to absorb variations in thickness of the soles of normal boots.

To this end, the binding according to the invention comprises:

a mounting secured to the support;

a jaw arranged to pivot about a first axis on the mounting in a manner such that it can move between a position in which the boot is held to the support and a position in which the boot is released;

a boot-removing lever arranged to pivot about a second axis on the mounting, the lever and jaw cooperating by means of a ramp-and-stop system;

a resilient element urging the ramp and stop into contact with each other, the binding being characterized in that the resilient element is attached to the jaw and to the lever in such a manner that it applies a pull to the jaw and lever between its points of attachment.

The point at which the resilient element is attached to the jaw is located on the same side as the ramp-and-stop system, in relation to the point of attachment of the resilient element to the lever.

The resilient element is preferably located opposite the ski when considering the pivot axes of the jaw and the lever on the mounting, in such a manner that the axes are as close as possible to the ski and are adjacent to each other. This reduces the size of the binding.

The size of the binding is also reduced by the advantage of arranging the pivot axes of the jaw and the lever so that they are substantially one above the other, the mounting thus extending vertically from the ski by a small amount.

In order to allow the resilient element to operate under suitable mechanical working conditions, the element is free to orient itself angularly at the points of attachment to the jaw and lever. The action of the resilient element will thus always be along the line joining the points of attachment.

According to one preferred example of embodiment of the invention, the ramp is arranged in the jaw, whereas the stop, which may be in the form of a rotating roller, is carried by the lever.

The resilient element may be in the form of any suitable resilient system exerting traction between these two points of attachment. However, according to a first example of embodiment, it may, with advantage, consist of a strip of rubber, one end of which is secured to the jaw and the other to the lever. According to another example of embodiment, the resilient element is in the form of a telescoping piston-and-hollow member unit hinged at one end to the jaw and, at the other end, to the lever, a spring operating under compression being arranged between the piston and hollow member.

A description will now be given, as a non-restrictive example, of two examples of embodiment of the heel-piece according to the invention illustrated in the drawings attached hereto, wherein.

In the example of embodiment illustrated in FIGS. 1 to 4, the heel-piece is designed not to allow safety releases. In other words, this is a binding in which the locking action, once established, cannot be reversed. The boot can therefore be released only intentionally by the skier.

It will therefore be assumed that the device according to FIGS. 1 to 4 is designed to hold a boot to a plate fitted, for example, to a ski, safety releases between the plate and the ski being achieved by means of a releasable holding device.

Figure 1:
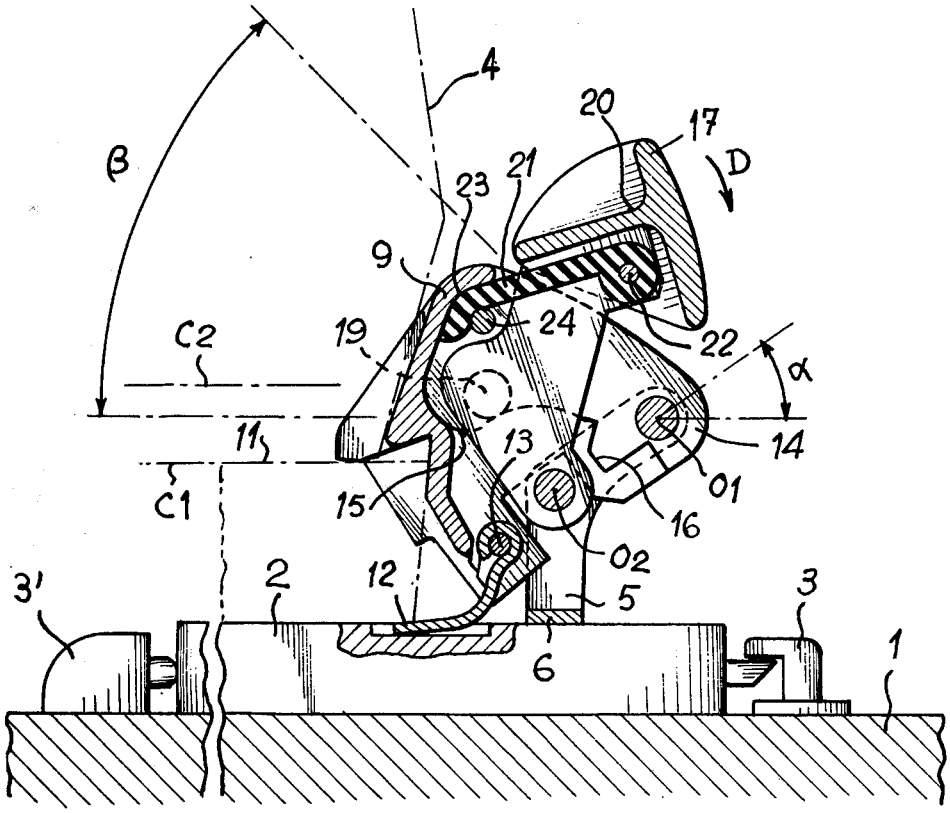
FIG. 1 shows a section through a first example of embodiment of the invention.

In FIG. 1, item 1 is a ski to which is fitted a plate 2 which is held to the ski by front and rear safety-release bindings 3' and 3. This type of binding is conventional and is not a part of the invention; it will therefore not be described in detail.

Shown at 4, in dotted lines, is the rear of a ski boot. The front of this boot is to be held firmly to plate 2 by means of a conventional stop (not shown), while the rear of the boot is held by the heel-piece according to the invention.

Although the heel-piece as shown is not intended to release itself but to lock the boot irreversibly, it may be open and closed by the skier intentionally for the purpose of securing the boot to, and releasing it from, the ski.

The binding comprises a stationary pedestal 5 which, in the example illustrated, is substantially U-shaped and has a web 6 which is secured to the plate.

The two arms of the pedestal have axes $O^1$ and $O^2$ which run parallel with the ski and are arranged in a manner such that the line $O^1O^2$ is at an angle $\alpha$ of about 35°, for example, to the ski in the example illustrated. A jaw 9, designed to hold boot 4 against plate 2, pivots about axis $O^1$. Jaw 9 has a step-in pedal 12 pivoting about an axis 13.

The jaw extends rearwardly in the form of two parallel cheeks 14 through which axis $O^1$ passes. The central portion of cheeks 14 is in the form of a ramp 15 which projects inwardly and is extended rearwardly in the form of a recess 16. A boot-removing lever 17 is arranged to pivot about axis $O^2$ between cheeks 14, the lever extending upwardly from axis $O^2$ and carrying, on each side, stops 19 which are cylindrical in the example illustrated. These stops 19 are integral with lever 17 and are intended to cooperate with ramps 15 of the holding element.

The upper end of lever 17 has a cavity 20 designed to accept the end of a ski stick used to move the lever in the direction of arrow D when the skier intentionally removes the boot from the ski.

Angle $\beta$ indicates the opening travel of the jaw. $C^1$ and $C^2$ are the extreme positions that can be reached by top 11 of the sole of the boot without preventing the heel-piece from being locked, the distance between $C^1$ and $C^2$ corresponding substantially to the amount of snow which can be tolerated under the boot without disturbing the functioning of the binding.

The binding is also equipped with a spring which, in the example illustrated, is in the form of a strip of rubber 21 capable of stretching, one end thereof being secured to lever 17 around an axis 22, while the other end is secured to jaw 9 by being pinched between wall 23 of the jaw and a pin 24 integral therewith. This strip of rubber exerts traction between axis 22 and pin 24, tending to maintain lever 17 in the position shown in FIG. 1.

Figure 2:
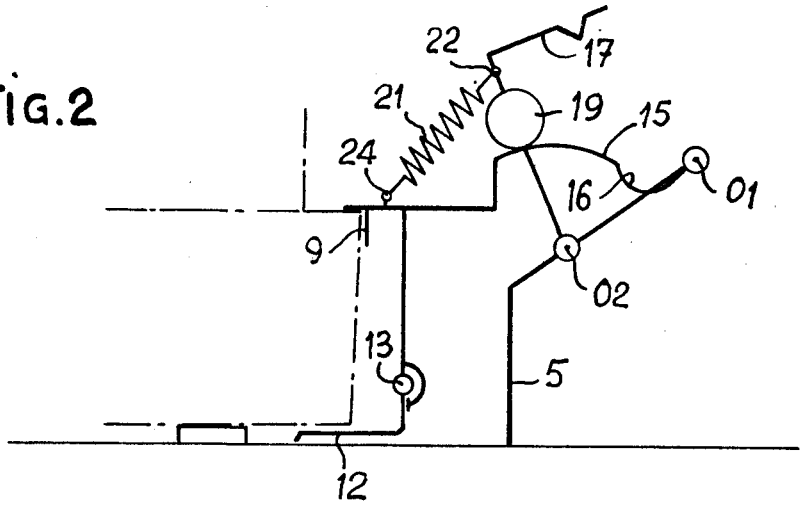
FIGS. 2, 3 and 4 are diagrams showing how the heel-piece according to FIG. 1 operates.
Figure 3:
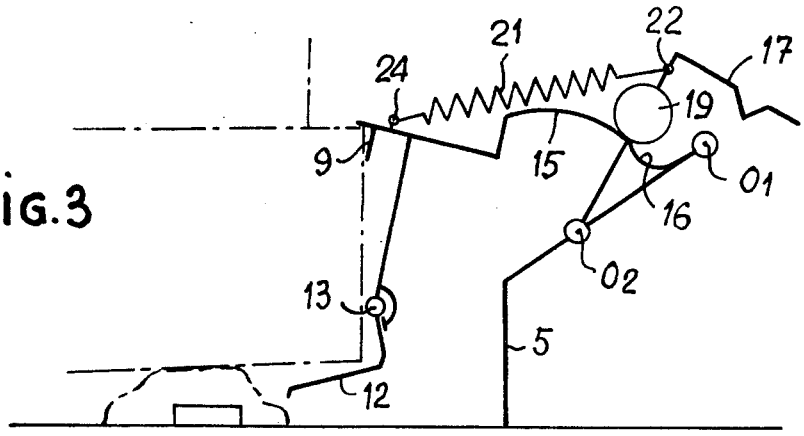

FIGS. 2 and 3 are diagrams illustrating the locking of the heel-piece according to FIG. 1: (*a*) in the case of a standard boot with no snow under the sole, and (*b*) in the case of a boot having snow under the sole (FIG. 3).

Figure 4:
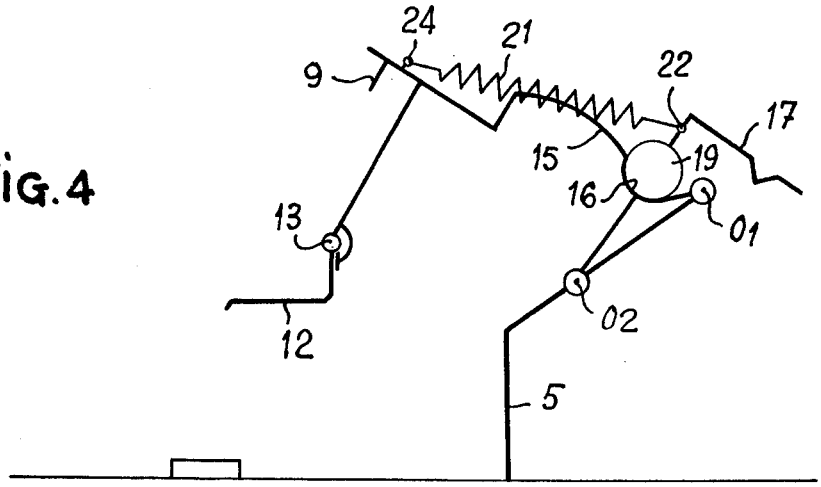

As for FIG. 4, this shows, diagrammatically, the device in the open position, after manual removal of the boot, with stop 19 engaged in recess 16 in the jaw.

The presence of spring 21 provides automatic opening and closing of the device at the end of the travel. Thus, in fitting the ski, when the boot bears upon the pedal, it causes the jaw to move a certain distance, lever 17, under the action of spring 21, pivots towards the jaw, and stop 19 emerges from recess 16 and moves along ramp 15 of the jaw. Spring 21 is then unloaded and the jaw and the lever move simultaneously, although their angular movements are relative.

At the end of a certain amount of travel, the lever makes use of the energy of the spring in order to close the jaw.

When the ski is removed, the procedure is reversed, i.e. after the lever has travelled a certain distance under spring tension, it becomes the driver and carries along the jaw. The latter opens under the action of the spring and remains open in the position shown in FIG. 4.

On the other hand, when the boot applies a vertically upward load to the jaw, the latter cannot pass from the "closed" position to the "open" position releasing the boot, since the angle of ramp 15 is such that there is not enough force to rotate the lever carrying roller 19 in a clockwise direction.

Figure 5:
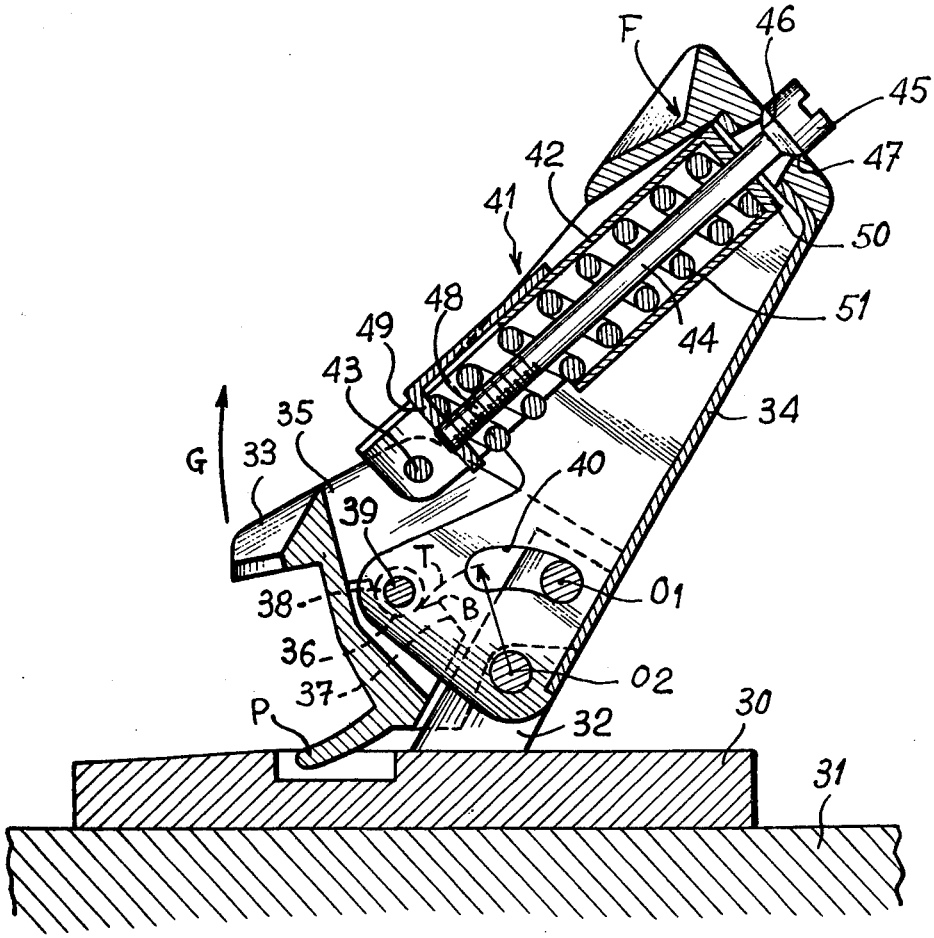
FIG. 5 shows a section through a second example of embodiment of the invention.
Figure 6:
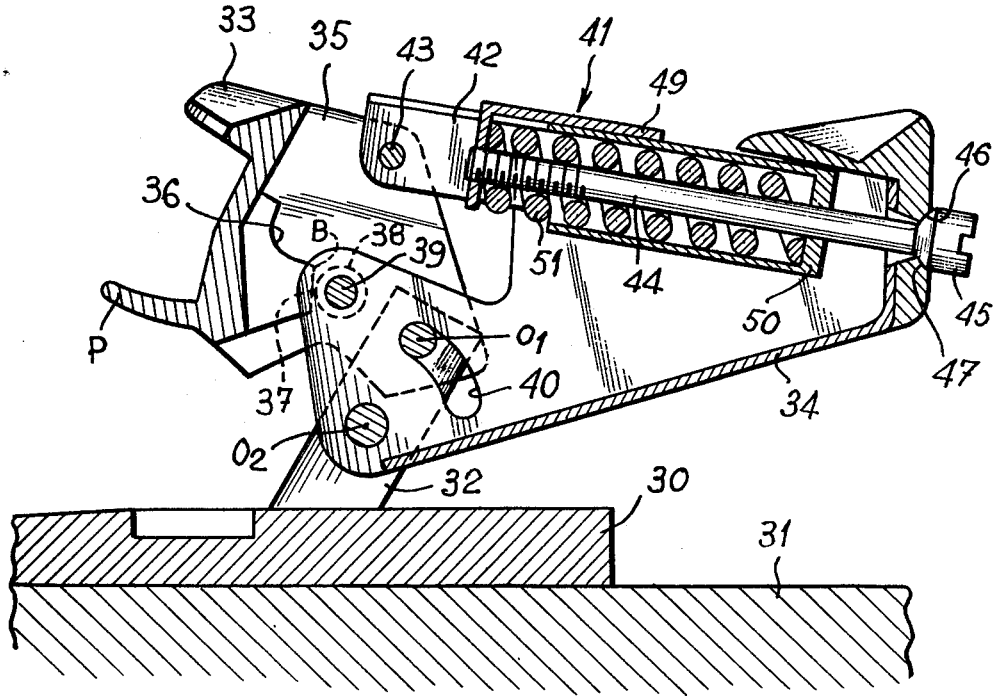
FIG. 6 shows the heel-piece according to FIG. 5 in another position.

The heel-piece illustrated in FIGS. 5 and 6 allows safety releases. It consists of a baseplate 30 secured to a ski 31, the base-plate comprising a mounting consisting of two wings 32 arranged at an angle to the ski; the mounting has a first axis $O^1$ about which a jaw 33 pivots, and a second axis $O^2$ about which a boot-removing lever 34 pivots.

In the example of embodiment illustrated in FIGS. 5 and 6, axis $O^1$ is located above axis $O^2$, but it is to be understood that this arrangement could be reversed without altering the operation of the heel-piece.

Lateral cheeks 35 of the jaw comprise a ramp 36 terminating in a heel 37, the ramp being designed to cooperate with a roller 38 running freely on an axis 39 carried by lever 34.

The sides of lever 34 contains slots 40 accommodating stationary axis $O^1$, the slots allowing lever 34 to move in relation to jaw 33.

Located between jaw 33 and lever 34 is a telescoping resilient element marked 41 as a whole, the element consisting of a hollow elongated member 42, the base of which is hinged, at 43, to the upper part of jaw 33; the piston of the telescoping resilient element is in the form of a threaded rod 44, head 45 of which has a hemispherical surface 46 bearing upon a spherical seat 47 on lever 34. Threaded end 48 of the rod carries a plate 49 which slides in member 42. Located between plate 49 of the piston and bottom 50 of member 42, and surrounding rod 44, is a spring 51 working in compression. It will be understood that, in this arrangement, the action of the spring tends to move axis 43 towards head 45 of rod 44.

When a load in the direction of arrow G (FIG.5) is applied to jaw 33, the latter tends to pivot about axis $O^1$, and ramp 36 imparts to lever 34, through roller 38, a rocking movement. Roller 38 rolls upon ramp 36, and the relative movement between the jaw and lever compresses spring 51.

As soon as roller 38 reaches nose B located between ramp 36 and heel 37 thereof, a safety release occurs, whereupon the unit assumes the position illustrated in FIG. 6. It will be observed that the position illustrated in FIG. 6 is stable, in that roller 38 bears against heel 37 and this prevents any unwanted closing of the binding.

In order to fit the boot to the ski, the skier merely has to apply pressure to pedal P, integral with the jaw. This causes the latter to descend, and lever 34 returns to its upright position under the action of telescoping resilient element 41.

In order to remove the boot intentionally, the skier applies pressure, in the direction of arrow F, to the top of lever 34. This enables the lever to pivot freely against the action of spring 51, and roller 38 follows a path T which releases ramp 36 and therefore jaw 33. It is obvious that, in this example of embodiment, ramp 36 is arranged differently and at an angle other than that of ramp 15 in FIGS. 1 to 4.

What is claimed is:

1. A binding designed to hold a ski boot to a support, such as a ski or a plate mounted upon a ski, said binding comprising:

a mounting secured to said support, a jaw mounted to pivot about a first axis of said mounting, said axis being parallel to the surface of the ski in such a manner that said jaw is able to move between:

(a) a position in which the boot is held to the support, (b) a position in which the boot is released;

a boot-removing lever mounted to pivot about a second axis on said mounting, said second axis being parallel with said first axis, ramp and stop means provided respectively on one of said lever and jaw and a resilient means urging said ramp and said stop means into contact with each other, said resilient means being attached to said jaw and to said lever in such a manner that it exerts traction between points of attachment of said resilient means to said jaw and said lever and causes automatic closing and opening of said jaw upon actuation of said lever.

2. A binding according to claim 1, wherein said resilient means, at the level of its points of attachment to the jaw and the lever, is free to orient itself angularly.

3. A binding according to claim 1, wherein the point of attachment of the resilient means to the jaw is located, in relation to the point of attachment of said resilient means to the lever, on the same side as said ramp and stop means.

4. A binding according to claim 1, wherein said resilient means is located opposite the ski when considering said axes of said jaw and said lever on the mounting.

5. A binding according to claim 1, wherein said axes of said jaw and said lever are located substantially one above the other.

6. A binding according to claim 1, wherein said ramp means is arranged in the jaw, whereas said stop means is carried on said lever.

7. A device according to claim 1, wherein the axis of said lever is located between the jaw and the axis of rotation of said jaw on the mounting.

8. A binding according to claim 1, wherein said resilient means is in the form of a strip of rubber acting in traction, one end of said strip being secured to said jaw and the other to said lever.

9. A binding according to claim 1, wherein said resilient means is in the form of a telescoping piston and cylinder unit, one end thereof being hinged to said jaw and the end to said lever.

10. A binding according to claim 9, wherein a spring acting in compression is located between said piston and said cylinder of the telescoping unit.

11. A binding according to claim 10, wherein one end of said cylinder is hinged to the axis of said jaw, whereas the other end is free.

12. A binding according to claim 11, wherein said piston is in the form of a rod passing through the free end of said cylinder and carrying a part arranged to slide therein, said spring being mounted upon said rod between the free end of the cylinder and said part carried by the rod.

13. A binding according to claim 12, wherein said rod has a head with a spherical surface bearing upon a spherical seat on the lever.

14. A binding designed to hold a ski boot to a support, such as a ski or a plate mounted upon a ski, said binding comprising:

a mounting secured to said support, a jaw mounted to pivot about a first axis of said mounting, said axis being parallel to the surface of the ski in such a manner that said jaw is able to move between:

(a) a position in which the boot is held to the support, (b) a position in which the boot is released;

a boot-removing lever mounted to pivot about a second axis on said mounting, said second axis being parallel with said first axis, ramp and stop means provided respectively on one of said lever and jaw, means for temporarily locking said lever relative to said jaw after said lever has been moved relative to said jaw for achieving voluntary unlocking of the binding, and a resilient means urging said ramp and said stop means into contact with each other, said resilient means being attached to said jaw and to said lever in such a manner that it exerts traction between points of attachment of said resilient means to said jaw and said lever.

15. A binding according to claim 14, wherein said ramp means is arranged in the jaw and said stop means is carried by the lever, said means for locking said lever being constituted by a recess provided at the end of the ramp means, said stop means cooperating with said recess at the end of the displacement of the lever relative to said jaw.

* * * * *

UNITED STATES PATENT AND TRADEMARK OFFICE

CERTIFICATE OF CORRECTION

PATENT NO. : GEORGES, PIERRE, JOSEPH SALOMON

DATED : 4,097,062

INVENTOR(S) : JUNE 27, 1978

It is certified that error appears in the above-identified patent and that said Letters Patent are hereby corrected as shown below:

Through applicant's mistake, the word "Salomon" was omitted from the assignee's name, which should properly read:

--Etablissements François Salomon et Fils--

Signed and Sealed this

*Eleventh* Day of *December 1979*

[SEAL]

*Attest:*

SIDNEY A. DIAMOND

*Attesting Officer*

*Commissioner of Patents and Trademarks*